US006962254B2

(12) United States Patent
Spector

(10) Patent No.: US 6,962,254 B2
(45) Date of Patent: Nov. 8, 2005

(54) UNIVERSAL BOTTLE CAP

(76) Inventor: Donald Spector, 641 Fifth Ave., New York, NY (US) 10022

( * ) Notice: Subject to any disclaimer, the term of this patent is extended or adjusted under 35 U.S.C. 154(b) by 0 days.

(21) Appl. No.: 10/943,712

(22) Filed: Sep. 17, 2004

(65) Prior Publication Data

US 2005/0029130 A1 Feb. 10, 2005

Related U.S. Application Data

(63) Continuation-in-part of application No. 10/463,927, filed on Jun. 18, 2003, now Pat. No. 6,820,740.

(51) Int. Cl.[7] ..... B65D 25/08
(52) U.S. Cl. ..... 206/222; 215/250
(58) Field of Search ..... 206/219–222, 206/568, 820; 215/6, 250, DIG. 8

(56) References Cited

U.S. PATENT DOCUMENTS

| | | | | | |
|---|---|---|---|---|---|
| 2,631,521 | A | | 3/1953 | Atkins, Jr. | |
| 2,859,898 | A | | 11/1958 | Mendenhall | |
| 3,655,035 | A | * | 4/1972 | Muhlbauer | 206/219 |
| 3,841,467 | A | * | 10/1974 | Hansen | 206/219 |
| 4,776,972 | A | * | 10/1988 | Barrett | 206/221 |
| 5,246,142 | A | | 9/1993 | DiPalma et al. | |
| 5,509,530 | A | * | 4/1996 | Wilson | 206/220 |
| 5,697,495 | A | * | 12/1997 | Abrams et al. | 206/5.1 |
| 5,772,017 | A | | 6/1998 | Kang | |
| 5,941,380 | A | | 8/1999 | Rothman | |
| 6,092,648 | A | * | 7/2000 | Sellars | 206/221 |
| 6,098,795 | A | | 8/2000 | Mollstam et al. | |
| 6,170,654 | B1 | * | 1/2001 | Gartner et al. | 206/219 |
| 6,372,270 | B1 | * | 4/2002 | Denny | 206/219 |
| 2003/0072850 | A1 | | 4/2003 | Burniski | |
| 2004/0026270 | A1 | * | 2/2004 | Liang | 206/219 |

* cited by examiner

*Primary Examiner*—Luan K. Bui
(74) *Attorney, Agent, or Firm*—Glen M. Diehl; Norton & Diehl LLC

(57) ABSTRACT

A bottle cap for universal retrofitting to one of a number of pre-existing beverage containers containing a beverage and having a removed cap and threaded aperture, having at least one container portion for containing at least one dispensable material, a threaded portion for receiving the threaded aperture and creating, when threaded, a watertight assembly; and bag containing the dispensable material and located in the container portion. Upon screwable attachment of the threaded aperture into the cap, the threaded aperture parses at least a portion of the bag to permit feeding of the material into the beverage. A plurality of such caps are also shown packaged for commercial sale. The material contained in the cap is selected from the group consisting of vitamins, medicaments, teas, flavors, concentrates and water-soluble food material. Also shown is a universal cap further having a moveable aperture assembly creating an open, fluid-flowing state and a closed, fluid-stopped state, having a top portion containing a drinking aperture and an elongated, moveable fluid-flowing portion.

7 Claims, 5 Drawing Sheets

UNIVERSAL BOTTLE CAP

CROSS-REFERENCE TO RELATED APPLICATIONS

This is a continuation-in-part Ser. No. 10/463,927 of U.S. Pat. No. 6,820,740, filed on Jun. 18, 2003, and issued on Nov. 23, 2004 the disclosure of which is herein incorporated by reference.

FIELD OF THE INVENTION

The present invention relates to the field of beverages, and more specifically to beverages contained in bottles with removal caps, such that a cap can be retrofittedly placed upon the bottle, post removal of its originating cap, in a manner that dispenses materials including, e.g., vitamins and flavors, into the beverage.

BACKGROUND OF THE INVENTION

The beverage world today is largely possessed by bottled water contained in plastic bottles having virtually identical removable caps. Such caps are removed by twistable action, leaving a band or collar behind as the cap is removed, while simultaneously providing access for drinking to the top of the bottle. Beverages also comprise pre-mixed drinks with a plurality of different designs, requiring, among other things, refrigeration, dates of expiration and other indicators related to the shelf-life of the beverage.

Well known in the art are water-soluble drink mixes that are sold in solid form. The consumer measures quantities of the dry material, adds the quantities in the proper ratio to water, and creates a flavored beverage. In these embodiments, the consumer is required to modulate the quantities, and mistakes result in under- or over-flavored mixtures.

It is important to maintain freshness of fluid-based products. This is particularly important when the material to be dispensed is vitamin-based, since it is known that water-miscible vitamins can lose their potency over time when in a fluid environment, through changes in, inter alia, temperature, pressure, and light. In addition, fluid-based products can interact with plastic bottles, causing an unpleasant taste and comprising the health of the user. Glass bottles are thus required, which are more expensive and much heavier.

Heretofore unknown in the art, is a universal cap design that contains dry or concentrated materials including, e.g., vitamins, drink mixes and other flavors, such that the cap is capable of utilization with any number of fluid containers, predominantly water, without the need for modification of the existing, standard, plastic bottle design. In other words, once the pre-existing cap is removed, the new cap, containing the materials, can be retrofittedly installed upon the bottle top, dispensing the materials into the fluid. The result can be shaken and the completed beverage created moments before consumption.

Known devices include U.S. Publication No. 2003/0072850 to Burniski, U.S. Pat. No. 6,098,795 to Mollstram, U.S. Pat. No. 5,772,017 to Kang, U.S. Pat. No. 5,246,142 to DiPalma, and U.S. Pat. No. 2,859,898 to Mendenhall. These devices, however, incorporate convoluted mechanisms that do not permit retrofitting to pre-existing bottle designs, and rather have cumbersome mechanisms for rotation and dispensation. Moreover, from the practical consumer vantage point, at purchase point, both an associated cap and fluid product must be acquired in pre-packaged form. Unknown is the disassociation of the two, permitting the consumer to purchase, independently, caps with a plurality of different materials contained therein, and standard, plastic fluid bottles.

It is thus an object of the instant invention to provide a universal, single-use cap containing materials for attachment to pre-existing fluid containers to permit dispensation of materials thereby maintaining the freshness of the beverage.

It is a further object of the instant invention to provide a universal cap in a plurality of different flavors for single-use attachment to pre-existing fluid containers, for simple access by a consumer.

It is a still further object of the instant invention to provide a plurality of universal caps having different materials, like vitamins, contained therein, such that consumers can independently purchase such caps from the decision to purchase their favorite forms of beverages, like water.

It is a still additional and further object of the instant invention to provide a plurality of universal caps having different flavors, like teas, contained therein, such that consumers can have fresh tea products in their favorite form of bottled water.

SUMMARY OF THE INVENTION

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention.

The foregoing objects and other objects of the invention are achieved through a bottle cap for universal retrofitting to one of a number of pre-existing beverage containers containing a beverage and having a removed cap and threaded aperture. In general, a majority of water and other beverages are packaged in a standard bottle having a removable cap, leaving behind, upon its removal, screw threads. The cap of the subject invention mates with these screw threads to create a water-tight assembly by having a screwable attachment portion for receiving the screw threads of the top of the bottle. Alternatively, the cap can be a plug-type device that is simply pushed into the bottle.

The cap further has at least one container portion for containing at least one dispensable material. The material is selected from the group consisting of vitamins, medicaments, teas, flavors, concentrates and water-soluble food material. This dispensable material is located in a sealed bag or packet formed of a parseable membrane material. The bag or packet is located in an upper portion of the cap, positioned across the cap. Upon screwable attachment of the threaded aperture into the screwable attachment means, the threaded aperture parses at least a portion of the bag or packet to permit feeding of the material into the beverage. Once parsed, the material freely flows into the beverage, either through gravitational action, shaking, or a combination thereof. Once fed into the beverage, the material disburses, creating a fresh beverage. The bag can be mounted to the cap via any suitable means, such as adhesive or a plastic support ring. Because the bag is sealed and self-contained, there is no need to seal the bag in an airtight manner across the cap. Thus, even if some of the adhesive comes loose, the dispensable material is still securely stored within the bag until it is released by the user. The bag or packet is preferably perforated in the areas that are to be opened, to ease the opening of the bag by the user.

A plurality of such caps may be packaged for commercial sale. In this manner, different flavors or vitamin compositions are provided, and a consumer can purchase virtually any beverage that has a suitably mating screw thread to the unique cap defined herein.

In another embodiment, the universal cap has a moveable aperture assembly creating an open, fluid-flowing state and a closed, fluid-stopped state (often referred to as a "sports bottle") having a top portion containing a drinking aperture and an elongated, moveable fluid-flowing portion. The moveable fluid-flowing portion ahs a cutting end located adjacent the packet or bag. The movable portion is initially set into the open, fluid flowing state when the packet is sealed, and then lowered onto the packet or bag to parse the packet to release the material into the liquid. Again, the packet may be perforated in the areas next to the movable portion to facilitate opening by the moveable portion. After the material is mixed, the moveable aperture portion functions as a valve, allowing the user to move it to opened flowing states or closed states.

There is preferably a removable cap or collar placed over or around the moveable aperture assembly, to prevent premature depression of the aperture assembly during shipping and storage.

Other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
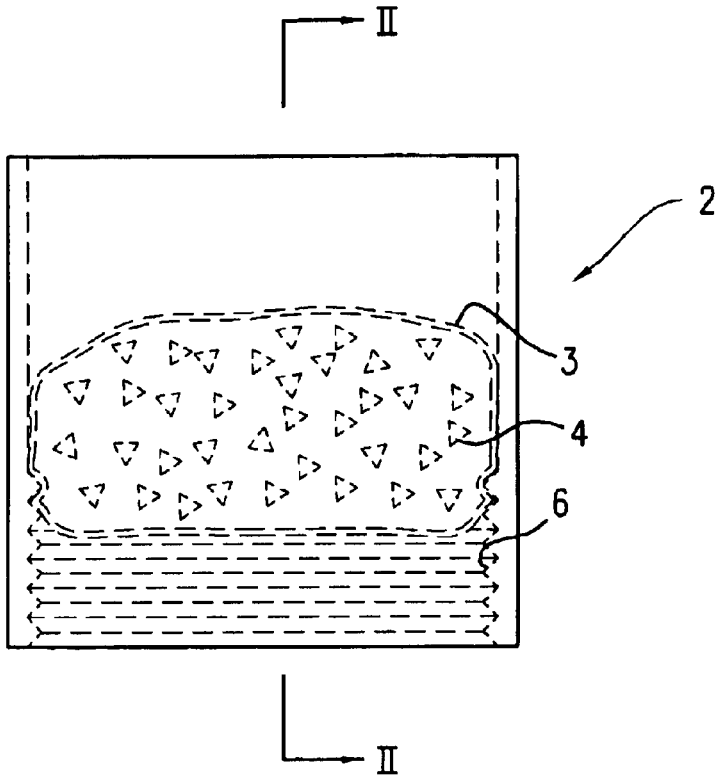
FIG. 1 is a perspective view of a cap in accordance with one embodiment of the subject invention.

In accordance with the subject invention, FIG. 1 shows a perspective view of cap 2, having a container portion formed from a bag 3 containing material 4 for dispensation into a beverage, upon attachment. Bag 3 is located above screw threads 6, for reasons shown and explained in greater detail in connection with FIG. 3.

Figure 2:
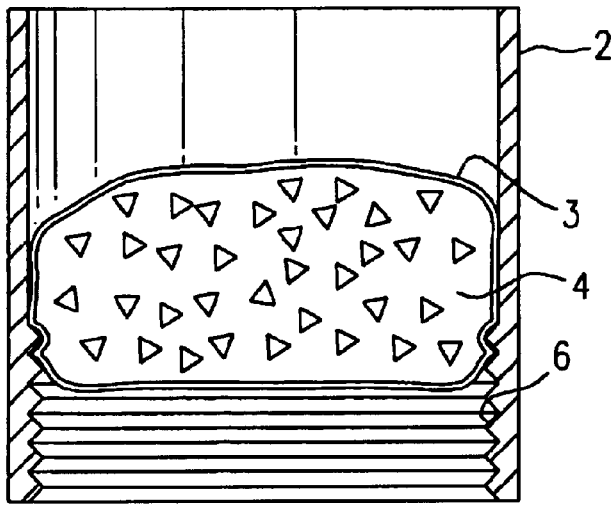
FIG. 2 is a cross-sectional view of the cap shown in FIG. 1, taken along line II—II shown therein.

FIG. 2 shows a cross-section of cap 2, shown in FIG. 1, taken along line II—II of FIG. 1, wherein bag 3 is shown holding material 4.

Figure 3:
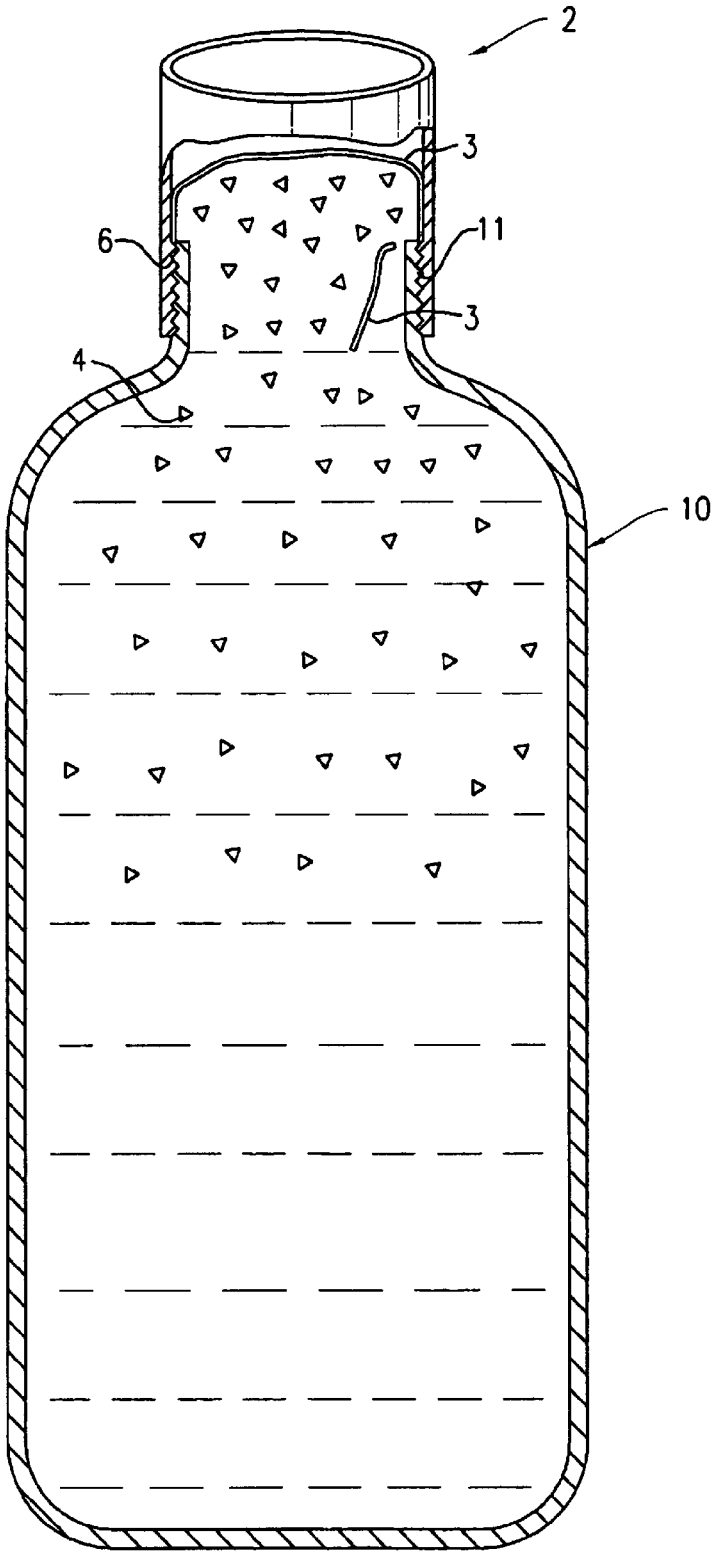
FIG. 3 is perspective view of the cap installed upon a bottled beverage container showing the parsing of the bag and the dispensation of material, in accordance with a preferred embodiment of the subject invention.

FIG. 3 reveals the attachment of cap 2 to a bottle 10 containing a beverage, in which the screw threaded upper region 11 of bottle 10 has parsed bag 3, shown in parsed form therein, permitting material 4 to feed into the beverage. It should be understood that bag 3 is simply parsed by the effect of screwing the upper threaded region of bottle 10 into the receiving means 6, and that no further action is required. Bag 3 can be perforated to enable easier opening of bag 3.

Figure 4:
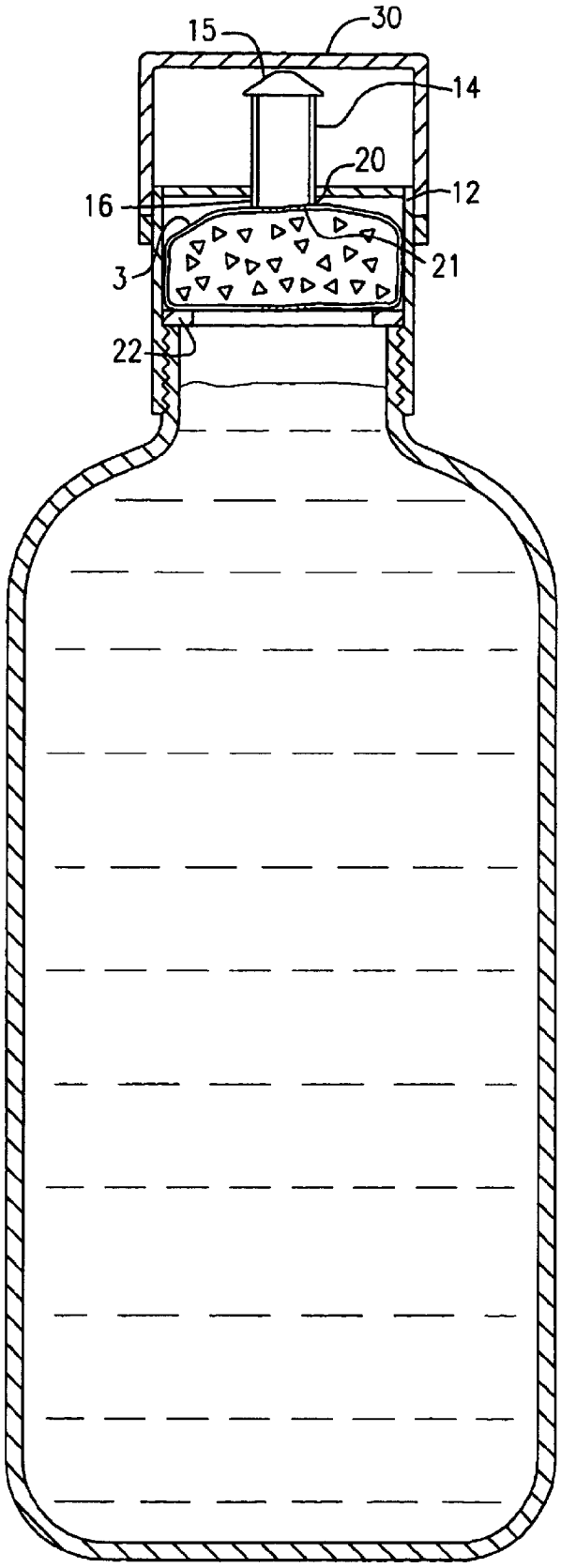
FIG. 4 is a perspective view of an alternative cap assembly having lockable fluidstopped and fluid-flowing states, in accordance with an alternative embodiment of the subject invention.
Figure 5:
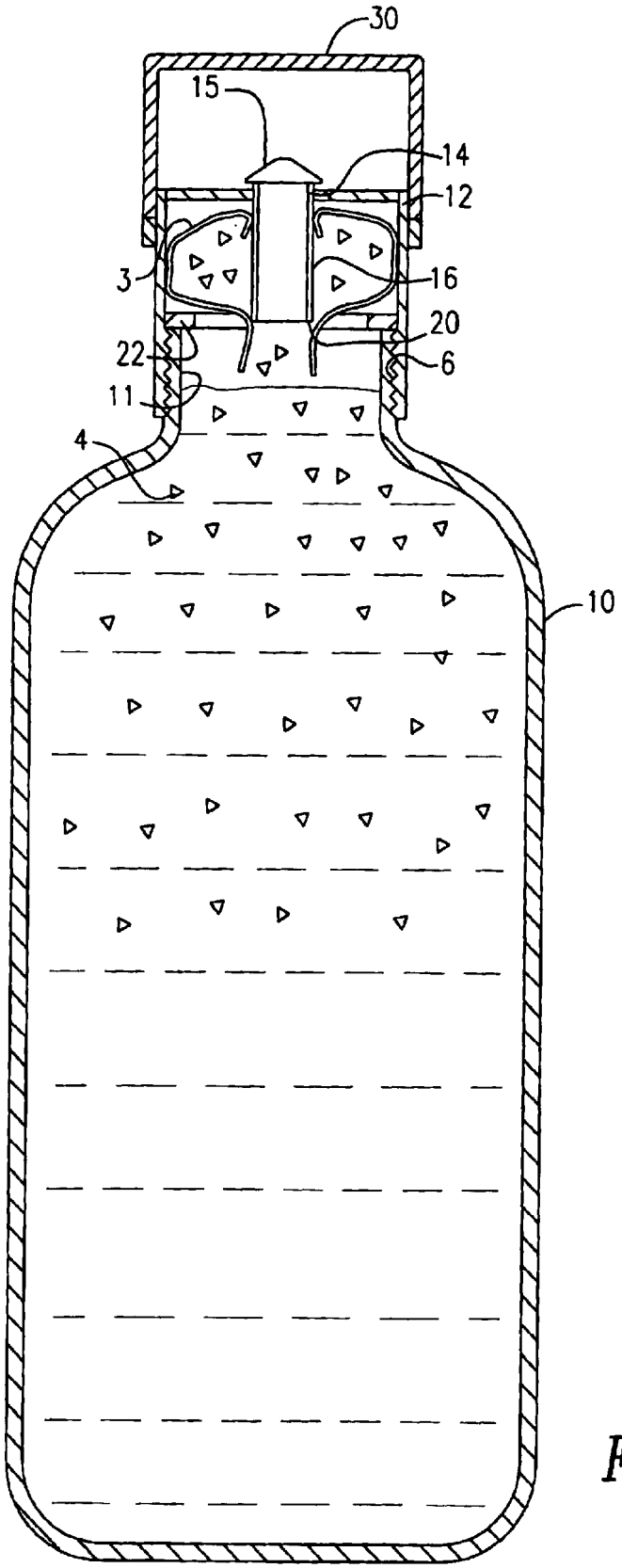
FIG. 5 is a perspective view of the alternative cap of FIG. 4, shown attached to a bottle in the fluid-flowing state.

FIG. 4 shows an alternative embodiment of a cap 12, having a moveable aperture assembly 14 creating an open, fluid-flowing state and a closed, fluid-stopped state, having a top portion 15 as a drinking aperture and an elongated, moveable fluid-flowing portion 16 which rides above bag 3. It should be understood that portion 16 can also attach to bag 3, such that screwable assembly does not break the membrane forming bag 3 but, rather, only movement of assembly 14 downward breaks the bag. In use, assembly 14 is initially placed into the opened state, and when mixing of the liquid and material in bag 3 is desired, assembly 14 is depressed until cutting end 20 perforates bag 3, as shown in FIG. 5. Bag 3 has perforations 21 to facilitate the perforation of bag 3.

Bag 3 can be held in place by plastic ring 22, or by any other method, such as by adhesive.

Preferably, a vap 30 is removably placed over assembly 14, to prevent inadvertent depression of assembly 14, which would prematurely perforate bag 3. Cap 30 could also be in the form of an open-topped collar.

In yet an alternative embodiment (not shown) the cap could be in the form of a plug that is press-fit into the bottle opening, or could be in the form of a cap that is press-fit around the outer rim of the bottle opening, thus not requiring any threads to keep it in place. Any other suitable means for attaching the cap could also be used.

Figure 6:
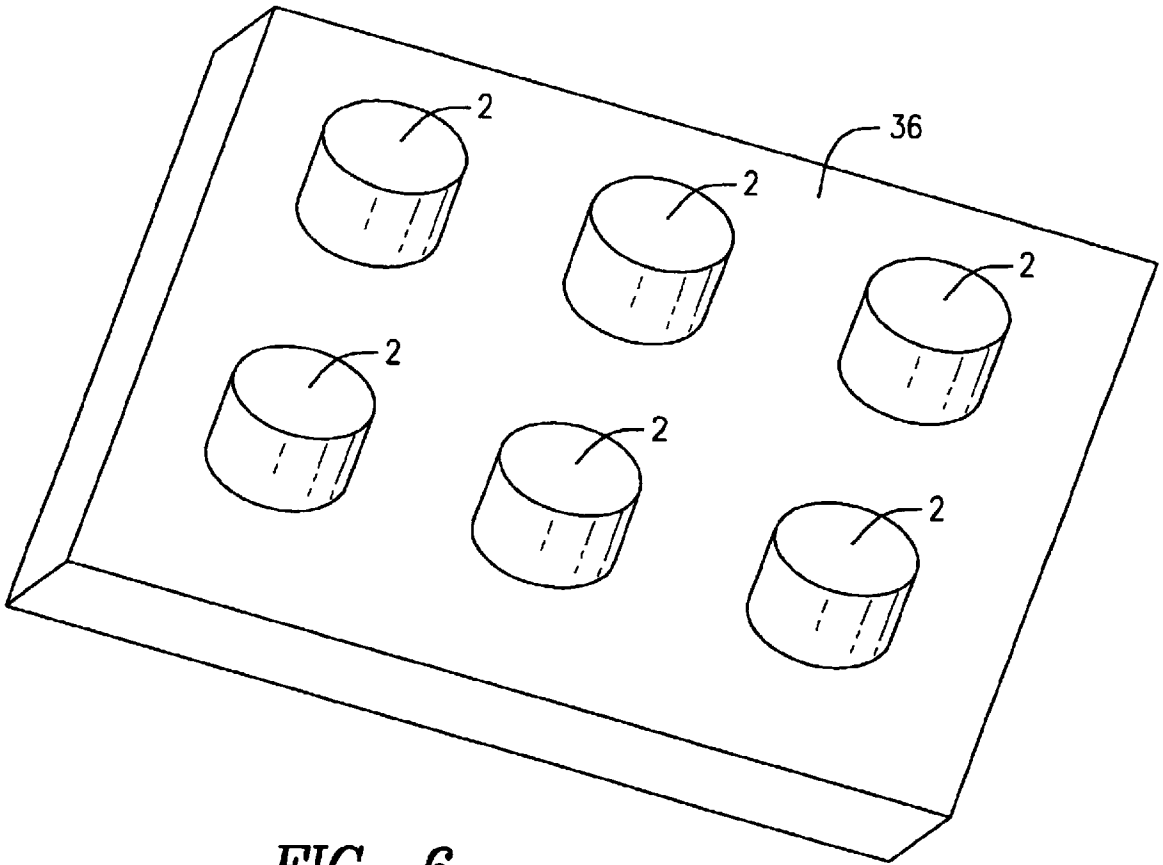
FIG. 6 is a perspective view of a plurality of caps in a consumer saleable package, in accordance with another embodiment of the subject invention.

FIG. 6 shows a plurality of caps 2 in a consumer saleable package design 36, packaged for commercial sale.

While there have been shown, described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A bottle cap for universal retrofitting to one of a number of pre-existing beverage containers containing a beverage and having a removed cap and aperture, comprising:

(a) at least one container portion;

(b) an attachment for receiving the aperture and creating, when twisted, a water-tight assembly;

(c) a parseable bag located in the container portion and containing dispensable material; and (d) a moveable aperture assembly creating an open, fluid-flowing state and a closed, fluid-stopped state, having a top portion containing a drinking aperture and an elongated, moveable fluid-flowing portion, wherein moving the assembly from the open-fluid flowing state to the closed fluid-stopped state causes the assembly to parse the bag and release the dispensable material into the beverage container.

2. The universal cap of claim 1, wherein a plurality of such caps are packaged for commercial sale.

3. The universal cap of claim 1, wherein said dispensable material is selected from the group consisting of vitamins, medicaments, teas, flavors, concentrates and water-soluble food material.

4. The universal cap of claim 1, wherein the bag is perforated to facilitate tearing.

5. The universal cap of claim 1, wherein the bag is securely attached to the cap via an adhesive.

6. The universal cap of claim 1, wherein the bag is supported in the cap by a ring connected to the cap, said bag resting on the ring.

7. The universal cap of claim 1, further comprising a device removably secured over the moveable assembly to prevent inadvertent depression of the moveable assembly.

* * * * *